US006439946B1

(12) United States Patent
Schneider

(10) Patent No.: US 6,439,946 B1
(45) Date of Patent: Aug. 27, 2002

(54) CHILDREN'S TOY WITH SELECTIVELY ACCESSIBLE INTERNAL CAVITY WITH ASSOCIATED STORAGE DEVICE

(76) Inventor: Joanne Schneider, 750 Freeway Cir., Suite 200, Middleburg Heights, OH (US) 44130

( * ) Notice: Subject to any disclaimer, the term of this patent is extended or adjusted under 35 U.S.C. 154(b) by 22 days.

(21) Appl. No.: 09/551,725

(22) Filed: Apr. 18, 2000

Related U.S. Application Data

(60) Provisional application No. 60/149,079, filed on Aug. 16, 1999.

(51) Int. Cl.[7] ..... A63H 3/00

(52) U.S. Cl. ..... 446/73; 446/268; 446/369

(58) Field of Search ..... 446/71, 72, 73, 446/74, 75, 76, 97, 268, 297, 369

(56) References Cited

U.S. PATENT DOCUMENTS

| | | | | | |
|---|---|---|---|---|---|
| 4,423,834 | A | * | 1/1984 | Rush | 446/268 |
| 4,754,512 | A | * | 7/1988 | Chao-Yang | 446/73 |
| 4,815,999 | A | * | 3/1989 | Ayon et al. | 446/73 |
| 4,878,871 | A | * | 11/1989 | Noto | 446/297 |
| 5,326,300 | A | * | 7/1994 | Sonders | 446/74 |
| 5,386,909 | A | * | 2/1995 | Spector | 446/73 |
| 5,547,412 | A | * | 8/1996 | Wilcox | 446/73 |
| 5,944,577 | A | * | 8/1999 | Yanofsky et al. | 446/73 |
| 6,023,822 | A | | 2/2000 | Luebke | 27/1 |

FOREIGN PATENT DOCUMENTS

| | | | |
|---|---|---|---|
| DE | 9107873 | 9/1991 | |
| DE | 9309158 | 11/1993 | |
| GB | 2322564 | 2/1998 | |
| GB | 0003778 | 1/2000 | |
| JP | 002153174 | 7/1997 | A61G/17/04 |

* cited by examiner

*Primary Examiner*—Sam Rimell
(74) *Attorney, Agent, or Firm*—Emerson & Skeriotis; Roger D. Emerson; Daniel A. Thomson

(57) ABSTRACT

A new and improved children's toy is disclosed having an internal cavity where valuables and the like may be stored. The cavity is easily and repeatedly accessible without damaging the toy. A container is provided for placing the valuables in, and then placing the container into the cavity.

11 Claims, 4 Drawing Sheets

CHILDREN'S TOY WITH SELECTIVELY ACCESSIBLE INTERNAL CAVITY WITH ASSOCIATED STORAGE DEVICE

This application claims benefit of 60/149,079, filed Aug. 16, 1999.

BACKGROUND OF THE INVENTION

A. Field of the Invention

This invention relates to the art of children's toys and dolls and the art of time capsules and storage devices, and more particularly to a doll or children's toy containing a time capsule. This application claims priority to a U.S. Provisional Patent Application Ser. No. 60/149,079, entitled CHILDREN'S TOY WITH SELECTIVELY ACCESSIBLE INTERNAL CAVITY WITH ASSOCIATED STORAGE DEVICE, filed on Aug. 16, 1999.

B. Description of the Related Art

Dolls and children's toys are well known in the art. Storage devices, such as safe deposit boxes, jewelry boxes, and safes, are also well known. However, until the current invention, it was not known to place a storage device within a cavity in a children's toy and have the storage device be repeatedly accessed by the user without damaging the toy.

One known type of doll containing a time capsule has a canister sewn into the doll and can only be removed by tearing and damaging the doll.

The present invention contemplates a new and improved collectible item or children's toy that contains a selectively accessible internal cavity with an associated storage device, which is simple in design, effective in use, and overcomes the foregoing difficulties and others while providing better and more advantageous overall results.

II. DEFINITIONS

The following term will have the following definition throughout the patent application:

Time Capsule a container holding historical records or objects representative of current culture as deposited for preservation until discovery by some future age.

III. SUMMARY OF THE INVENTION

In accordance with the present invention, a new and improved children's toy includes a selectively accessible internal cavity and a storage device.

In accordance with another aspect of the present invention, the toy also includes a door, preferably made of a soft material and attached to the body of the toy via Velcro®.

In accordance with yet another aspect of the present invention, the toy includes a rigid container inside the body of the toy for use as a container or time capsule.

In accordance with still another aspect of the present invention, the opening, cavity, and door can be made of any material or any design chosen using sound engineering judgment.

In accordance with another aspect of the present invention, a porcelain doll includes a front, a back, arms, legs, a head, a body, a cavity, the cavity being located in the back of the doll, the cavity for receiving an associated time capsule, a connecting strip, a first flap, a second flap, and a third flap, the flaps for concealing the cavity, the first flap being selectively attachable to the connecting strip via hook and eye connectors, the second and third flaps having second and third connecting strips, the second and third flaps being selectively attachable to each other.

In accordance with yet another aspect of the present invention, the collectible item has an associated body and an associated head, the collectible item comprising a time capsule, the time capsule being located substantially within the collectible item.

In accordance with still another aspect of the present invention, the collectible item is chosen from a list comprising dolls, stuffed animals, and toys.

In accordance with another aspect of the current invention, the collectible item has receiving means for receiving the time capsule, the receiving means is an internal cavity and the item further comprises enclosing means for enclosing the time capsule with the cavity.

In accordance with still another aspect of the present invention, the collectible item has the receiving means located substantially within the associated body.

In accordance with another aspect of the invention, the enclosing means includes a flap and connecting means for connecting the flap to the associated body and the enclosing means is selectively adjustable.

In accordance with another aspect of the present invention, a method of encapsulating deposited materials for preservation includes the steps of providing a collectible item having a body, a head, and receiving means for receiving the materials, placing the materials within the receiving means, placing the receiving means within the collectible item, the receiving means being located within the body of the collectible item, and enclosing the receiving means within the collectible item.

One advantage of the current invention is that a time capsule can be placed inside the toy.

Another advantage of the current invention is that the time capsule can be removed and replaced repeatedly without damaging the toy.

Still another advantage of the current invention is that the toy functions as both a toy and a time capsule.

Still other benefits and advantages of the invention will become apparent to those skilled in the art upon a reading and understanding of the following detailed specification.

IV. BRIEF DESCRIPTION OF THE DRAWINGS

The invention may take physical form in certain parts and arrangement of parts. Several embodiments of these parts will be described in detail in the specification and illustrated in the accompanying drawings, which form a part of this disclosure and wherein.

V. DESCRIPTION OF THE PREFERRED EMBODIMENT

Figure 1:
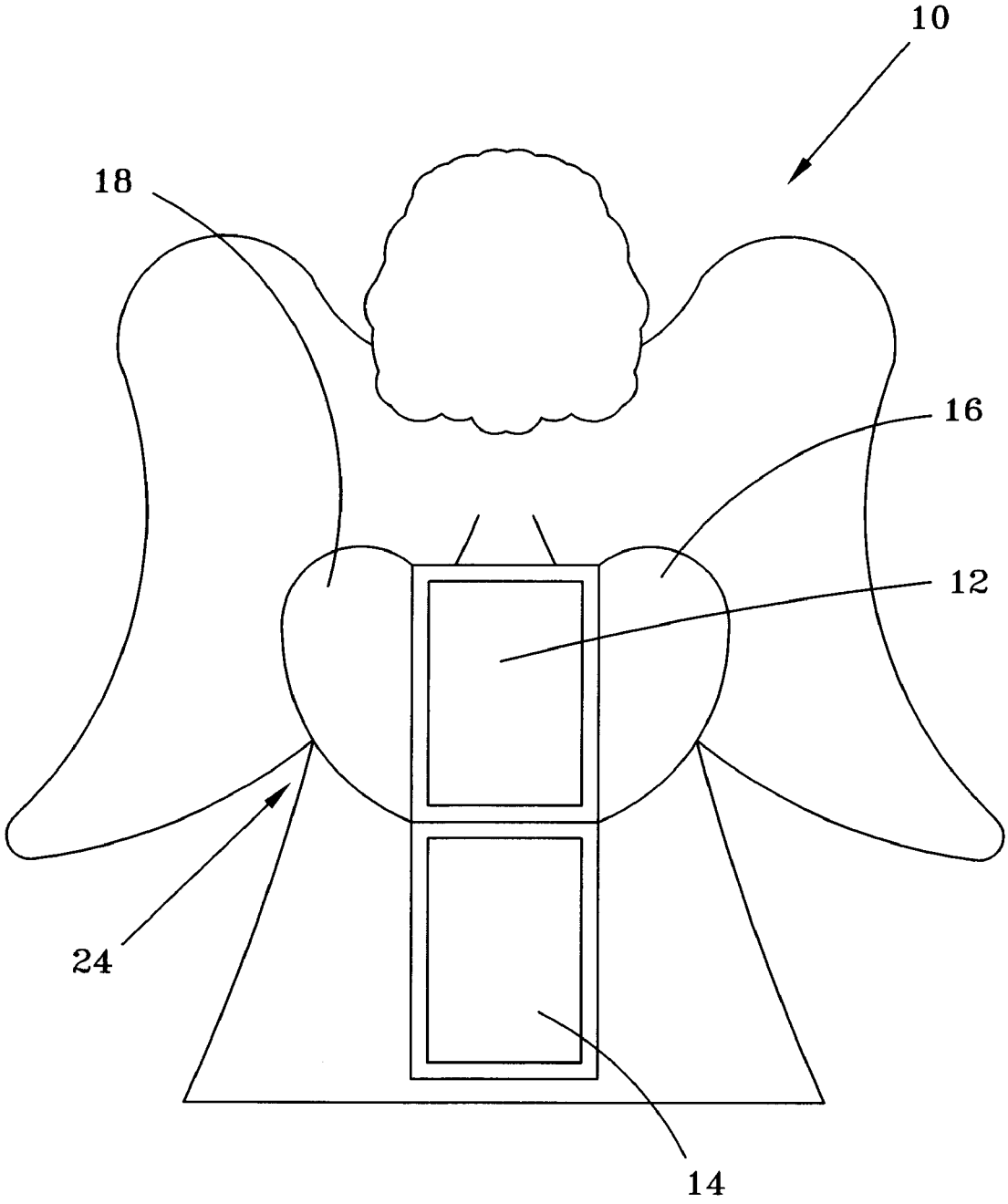
FIG. 1 is a back view of the doll, showing the storage means in the open position, with the capsule inside.

Referring now to the drawings, which are for purposes of illustrating several embodiments of the invention only, and not for purposes of limiting the same, FIG. 1 shows a doll 10 with a storage means 24 in the open position. In this embodiment, the storage means 24 closes on the back side (shown, but not referenced)) of the doll 10. It is to be understood that the storage means 24 can be located any place on the doll 10, as long as chosen using sound engineering judgment. For example, the storage means 24 could be located in either of the arms or legs or head of the doll 10. Any place that is large enough to receive a capsule 12 can be used as the storage means 24. It is also to be understood that this invention is not limited to the use of the doll 10 or the time capsule 12. Any toy, collectible item, stuffed animal, etc. can be used with this invention to contain the time capsule 12, as long as chosen using sound engineering judgment.

Figure 3:
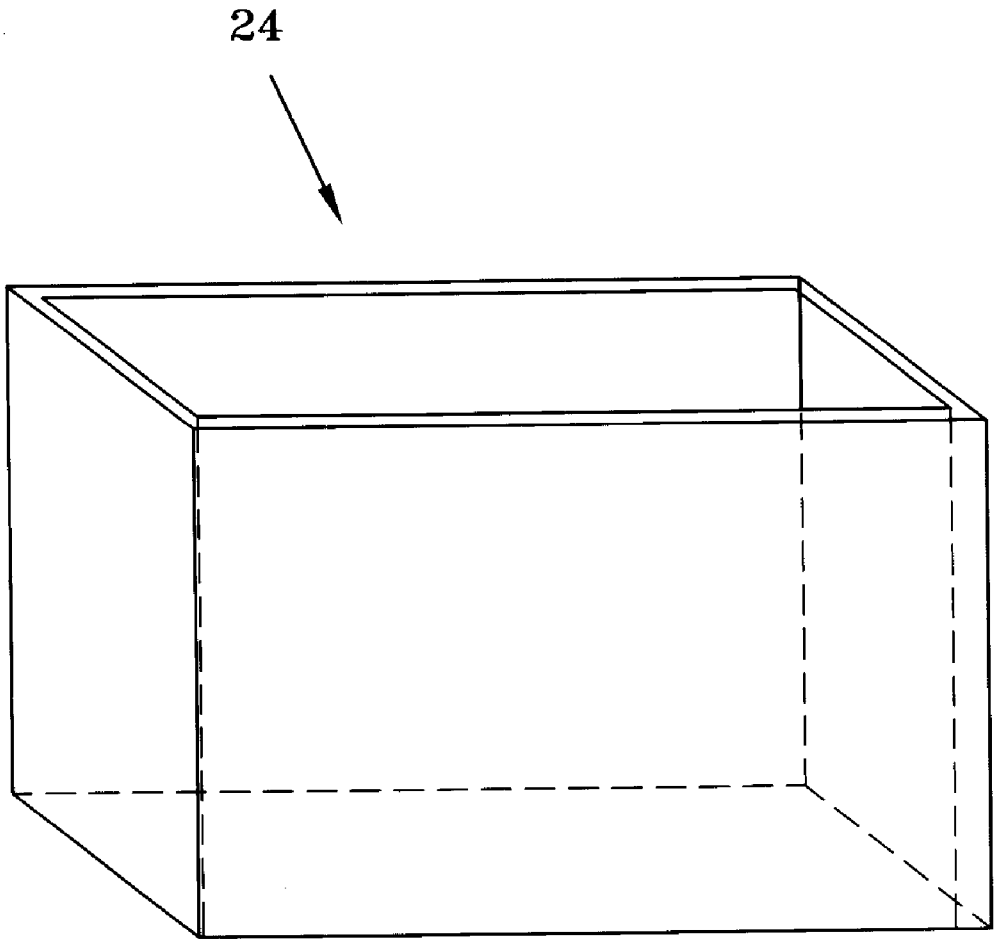
FIG. 3 is a perspective view of the storage means.

In this embodiment, the storage means 24 is a rigid container, or cavity, located inside the body of the doll 10. The storage means 24, one embodiment of which is shown in FIG. 3, is used for housing the capsule 12, or on the other hand, can be used as the time capsule 12 itself. The materials that are to be deposited within the capsule 12 could also be deposited within the storage means 24, without the use of the actual capsule 12. The cavity 24 can be made of any rigid, or semi-rigid material chosen using sound engineering judgment. The current invention is not limited, however, to a rigid or semi-rigid container. The time capsule 12 could simply be placed inside the body of the doll 10, without any type of housing. The cavity 24 could also be made of a soft, or non-rigid material. The invention encompasses any and all variations of the concept of placing a container 24 or time capsule 12 inside a toy.

FIG. 1 also shows a first flap 14, a second flap 16, and a third flap 18. The flaps 14, 16, 18 are used for enclosing the capsule 12 within the storage means 24. In this embodiment, the first flap 14, when in the open position, as shown in FIG. 1, extends outwardly and downwardly from the storage means 24. In order to enclose the capsule 12 within the storage means 24, the first flap 14 is folded in an upward direction toward the head of the doll 10. Once the first flap 14 is secured over the opening of the storage means 24, the second and third flaps 16, 18, are folded inwardly to cover the first flap 14. In this embodiment the flaps 14, 16, 18 are secured to the storage means 24 via Velcro® strips, but any means of connecting the flaps 14, 16, 18 to the storage means 24, or each other, can be used, as long as chosen using sound engineering judgment.

The flaps 14, 16, 18 can be opened and closed to cover or uncover the storage means 24 whenever necessary. This allows the capsule 12 to be selectively accessible.

Figure 2:
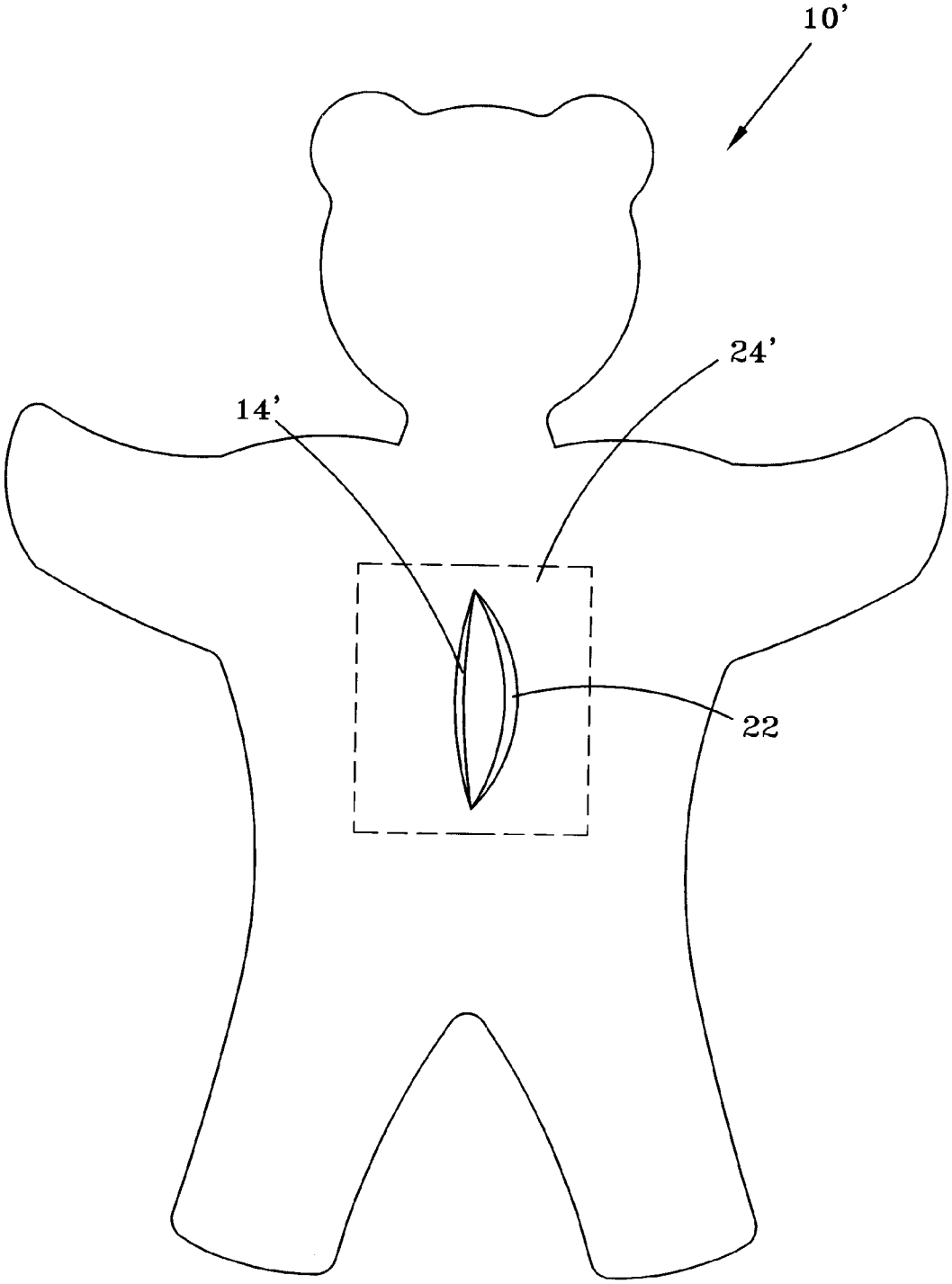
FIG. 2 is another embodiment of the invention, showing the storage means in a stuffed animal.

FIG. 2 shows another embodiment of the doll 10'. FIG. 2 shows a stuffed animal 10' with a storage means 24', connecting strip 22, and third flap 14'. As in the first embodiment shown in FIG. 1, the stuffed animal 10' has the storage means 24' located internally. The first flap 14' is selectively detachable from the connecting strip 22, using hook-and-eye connectors. This allows the capsule 12 to be selectively accessed by the user of the stuffed animal 10'. However, it is to be understood that the description of the first flap 14' in FIG. 2 is only one embodiment of the invention, and any means of selectively accessing and closing the storage means 24' can be used as long as chosen using sound engineering judgment. Also, the means for connecting the first flap 14' to the connecting strip 22 does not have to be the hook-and-eye connection, but can be accomplished using any means chosen using sound engineering judgment.

In another embodiment, the storage means 24 could be selectively accessible via a door (not shown), which is selectively movable on a vertical axis. In this embodiment, the door is made of cardboard or poster board and covered with material. The door attaches to the body of the toy 10 via Velcro® or other hook-and-loop fasteners. However, it is to be understood that the type of door, the material used for the door, and the means for attaching the door to the body of the toy 10 are not limitations of this invention and this invention contemplates any and all possible varieties of such. For example, the door could be made completely of a soft material, or it could be made of wood or metal. The door could also have its hinge on any of the four sides of the door. It is also contemplated within this invention that the door could be rolled back from the opening, or folded back from the opening.

The means of connecting the door to the toy could include buttons, hooks, snaps, zippers, ribbons, string, pins, straps, etc. Again, the invention is not limited to the particular means by which the door is attached to the opening.

With reference now to FIGS. 1–4, the invention contemplates a doll 10 with a rigid cavity 24 in the back area. The doll 10 can be any doll 10 made according to the known art of doll making. The rigid cavity 24 is large enough to house the capsule 12 that is approximately 6"×2½". The time capsule 12 is preferably a cylindrical canister with a screw-on lid. However, it is to be understood that the capsule 12 could be any means for containing materials using sound engineering judgment. The cavity 24 is fixedly attached to the body of the doll 10, and the top of the cavity 24 is flush with the back of the doll.

The cavity 24 can be used to store valuables, or anything else that a person wishes to place in the cavity 24 directly, or the user can place the valuables into a separate container 12 that is selectively accessible as well, and place the container 12 into the cavity 24. Once the valuables have been placed into the container 12 and the container 12 has been placed into the cavity 24, the door, or flaps 14, 16, 18 may then be shut and attached to the body of the doll 10. When the user desires to retrieve the valuables, or whatever else was placed into the container 12 or cavity 24, the user simply detaches the door, or flaps 14, 16, 18 from the body of the doll 10 and removes the desired articles.

Figure 4:
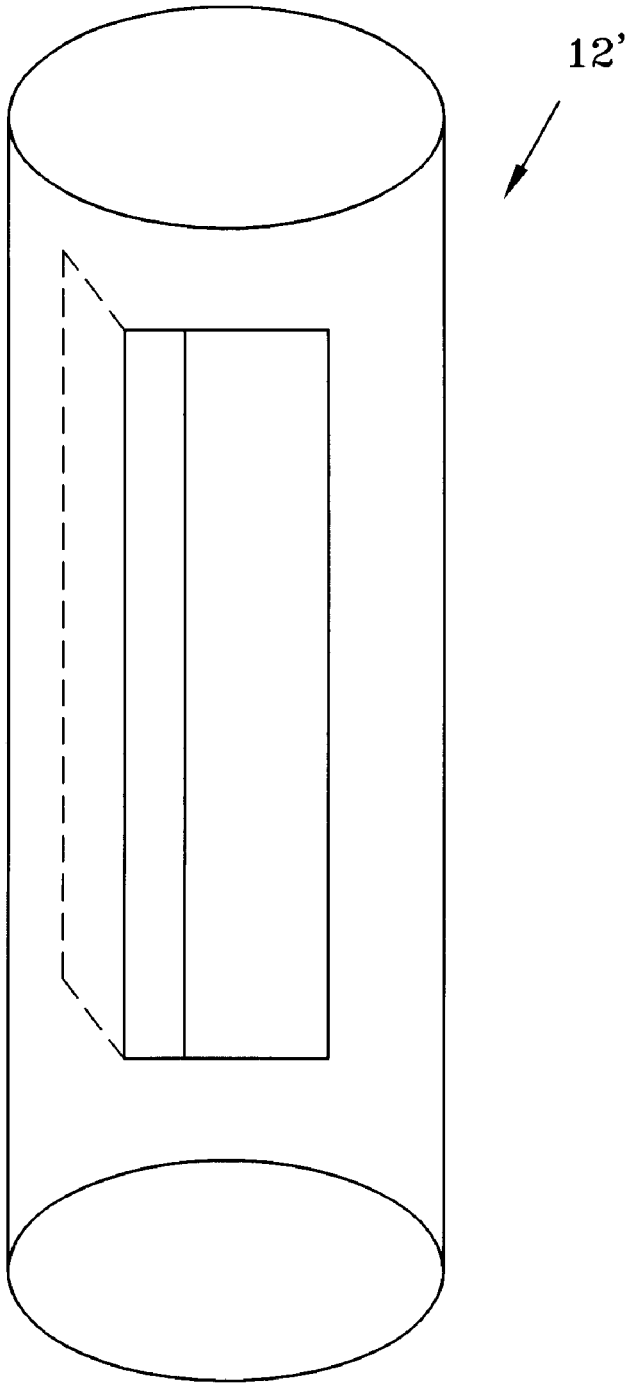
FIG. 4 is an enlarged view of one of the embodiments of the capsule.

With reference now to FIG. 4, another embodiment of the time capsule 12' is shown. In this embodiment, the capsule 12' resembles the canister used at drive-through banks for delivering money and other information. The time capsule 12' has a door (shown, but not referenced) that slides along the interior of the capsule 12'.

The invention has been described with reference to the preferred embodiment. Obviously, modifications and alterations will occur to others upon a reading and understanding of the specification. It is intended by applicant to include all such modifications and alterations insofar as they come within the scope of the appended claims or the equivalents thereof.

Having thus described the invention, it is now claimed:

1. A doll having a front, a back, arms, legs, a head, and a body, the doll comprising;

a internal cavity, the cavity being located in the back of the doll, the cavity receiving an associated container;

a connecting strip;

a first flap;

a second flap; and, a third flap, the flaps for concealing the cavitity, the first flap being selectively attachable to the connecting strip via hook and eye connector the second and third flaps having second and third connecting strips, the second and third flaps being selectively attachable to each other.

2. A collectible item comprising:

a body, the body having a torso, the torso having shoulders and a waist;

a substantially rigid internal cavity for receiving an associated container, the cavity located within the torso; and, enclosing means for enclosing the associated container within the cavity, the enclosing means located between the shoulders and the waist.

3. The item of claim 2, wherein the enclosing means comprises:

at least one flap; and, connecting means for connecting the flap to the torso.

4. The item of claim 3, wherein the enclosing means is selectively adjustable.

5. The item of claim 4, wherein the item further comprises:

a connecting strip;

a first flap;

a second flap; and, a third flap, the first flap being selectively attachable to the connecting strip, the second and third flaps being selectively attachable to each other.

6. The item of claim 5, wherein the second and third flaps have second and third connecting strips and the first flap being selectively attachable to the connecting strip via hook and eye fasteners.

7. The item of claim 6, wherein the item further comprises:

a container, the container being located substantially within the torso.

8. The item of claim 7, wherein the cavity is substantially rectangular.

9. The item of claim 2, wherein the enclosing means is substantially non-rigid.

10. A method of containing materials for preservation, the method comprising the steps of:

providing a collectible item having a body, a torso, shoulders, a waist, and a substantially rigid internal cavity, the cavity being located within the torso;

providing enclosing means located between the shoulders and the waist;

placing the materials within a receiving means;

placing the receiving means within the cavity; and, enclosing the receiving means within the cavity.

11. The method of claim 10, wherein enclosing the receiving means within the cavity comprises the steps of:

providing a connecting strip, a first flap, a second flap, and a third flap;

attaching the first flap to the connecting strip; and, attaching the second and third flaps to each other.

* * * * *